United States Patent [19]

Ott

[11] Patent Number: 4,838,937

[45] Date of Patent: Jun. 13, 1989

[54] STABILIZED ALKALINE GOLD BATH FOR THE ELECTRO-LESS DEPOSITION OF GOLD

[75] Inventor: Walter Ott, Graz, Fed. Rep. of Germany

[73] Assignee: Schering Aktiengesellschaft, Berlin and Bergkamen, Fed. Rep. of Germany

[21] Appl. No.: 165,832

[22] Filed: Mar. 9, 1988

[30] Foreign Application Priority Data

Mar. 9, 1987 [DE] Fed. Rep. of Germany ..... 3707817

[51] Int. Cl.[4] ..... B05D 5/12; C23C 16/00

[52] U.S. Cl. ..... 106/1.23; 106/1.26; 427/98; 427/304

[58] Field of Search ..... 106/1.23, 1.26; 427/98, 427/304

[56] References Cited

U.S. PATENT DOCUMENTS 3,589,916 6/1971 McCormack ..... 106/1.26
4,091,128 5/1978 Franz et al. ..... 427/304

FOREIGN PATENT DOCUMENTS 1058915 2/1967 United Kingdom ..... 106/1.26

OTHER PUBLICATIONS

Chem Abst: 104:114,477g, Murakami, 22 Jul. 85.
Chem Abst: 83:60793, Molenaar, Jun. 74.

*Primary Examiner*—Theodore Morris
*Attorney, Agent, or Firm*—Michael J. Striker

[57] ABSTRACT

A stabilized, aqueous, alkaline gold bath is disclosed, containing a dicyanogold(I)-complex, a complex-former, an alkali hydroxide and a reducing agent, for the electro-less deposition of gold onto gold, metals which are more electro-negative than gold, as well as alloys of these metals, characterized by a content of at least one compound from the classes of glycol derivatives and polyethylenimine, as stabilizer.

18 Claims, No Drawings

STABILIZED ALKALINE GOLD BATH FOR THE ELECTRO-LESS DEPOSITION OF GOLD

BACKGROUND OF THE INVENTION

The invention concerns a stabilized, aqueous, alkaline gold bath, containing a dicyanogold (I)-complex, a complex former, a reducing agent, and customary additives, for the electro-less deposition of gold onto gold and metals that are more electro-negative than gold, as well as alloys of these metals.

Gold baths for the electro-less deposition of gold, i.e. deposition without the use of electrical current, are already known. These are alkaline or acid gold baths which mostly contain an alkali-dicyanoaurate (I), a complex-former, a reducing agent, as well as additives for controlling the velocity of deposition and for improving the adhesive strength of the deposited layer of gold on the substrate. (See, e.g. United States Pat. Nos. 4,091,128; 3,300,328; 4,154,877; 3,032,436; German Offenlegungshriften DE-OS Nos. 2,052,787; and 2,518,559.) However, all of these baths display, as a rule, unsatisfactory stability, decomposing during the deposition of metallic gold.

In addition, the mentioned gold baths are suitable only for the gold-plating of metals which are more electro-negative than gold. Accordingly, an optimal electro-less deposition of gold onto gold is not possible using these known gold baths.

SUMMARY OF THE INVENTION

It is therefore an object according to the present invention to provide a stabilized, aqueous, alkaline gold bath with which it is possible to deposit gold in an electro-less process onto gold and metals that are more electro-negative than gold, as well as alloys of these metals.

This object is attained according to the present invention by a stabilized, aqueous, alkaline gold bath, containing a dicyano-gold(I)-complex, a complex-former, a reducing agent and an alkali hydroxide, characterized by a content of at least one compound selected from the group consisting of glycol derivatives and polyethylenimine as stabilizer.

Preferably, when a glycol derivative is employed as the stabilizer, it is ethylene glycol, diethylene glycol or polyethylene glycol.

The most preferred ethylene glycol stabilizer is of the formula $$R—O—CH_2—CH_2—OH$$

in which R represents hydrogen or alkyl with 1 to 5 carbon atoms, in particular, ethylene glycol monoethylether of the formula $$HO—CH_2—CH_2—OC_2H_5.$$

The most preferred diethylene glycol stabilizer is of the formula $$(R_1OCH_2CH_2)_2O$$

in which $R_1$ represents hydrogen and/or alkyl with 1 to 5 carbon atoms. In paticular, diethylene glycol monoethylether of the formula $$HO—CH_2—CH_2—O—CH_2—CH_2—OC_2H_5$$

is preferred.

The most preferred polyethylene glycol stabilizer is of the formula $$H(OCH_2—CH_2)_nOH$$

wherein n is an integer from 200 to 14,000.

When a polyethylenimine is employed as the stabilizer, it is preferably of the formula $$(—CH_2—CH_2—NH—)_n$$

in which n is an integer from 11 to 99.

The stabilizer should be provided in a concentration from 50 to 700 g/liter of bath.

The dicyano-gold(I)-complex is preferably selected from the group consisting of alkali-dicyanoaurate (I), in particular sodium- or potassium dicyanoaurate (I), and ammonium dicyanoaurate(I), and should be provided in a concentration from 0.05 to 30 g gold/liter (calculated as elemental gold.

The reducing agent is preferably an alkali-borohydride, e.g. Na or K, very stable in the electrolyte at pH 13.

The complex-former is preferably an alkali-cyanide, likewise usually the sodium or potassium species. It should be provided in a molar ratio from 1:5 to 1:10 relative to the didyano-gold(I)-complex, that is, a greater excess of free cyanide.

A particular advantage of the bath according to the present invention is that gold can be deposited from a stable bath onto gold surfaces, in an electro-less process. Thereby, already preent gold layers which are too thin can be optionally thickened by means of the bath according to the invention. This bath also makes possible the gold-plating of alloys, such as those which are customary in the semi-conductor industry. For example, iron/nickel- and iron/nickel/cobalt-alloys and chemically reductively deposited nickel alloys such as nickel/phosphorus, nickel/boron and even pure nickel can be gold-plated. The bath is also paricularly suitable for the deposition of gold onto diffusion layers such as e.g. nickel/gold or cobalt/gold.

It was not foreseeable that the designated glycol derivatives and polyethylenimine employed as stabilizer according to the present invention would provide such an outstanding effectiveness.

These compounds are all known per se, and can be prepared by known techniques.

Compounds with the most outstanding stabilizing ability include, for example, ethylene glycol monoethylether, diethylene glycol monoethylether and polyethylenimine.

Although the relative proportions of components of the bath according to the present invention may be varied almost without limit, it is a preferred embodiment to provide the following proportions of components:

| | |
|---|---|
| Gold (as metal) | 0.05–30 grams per liter |
| Stabilizer | 50–700 grams per liter |
| Alkalicyanide | 10–100 grams per liter |
| Alkalihydroxide | 5–100 grams per liter |
| Reducing agent | 10–100 grams per liter |

Particularly advantageous for stability is a molar ratio of reducing agent to stabilizer of 1:4.

The operational temperature of the bath can be selected between about 40° and 90° C. Surprisingly, however, even at higher temperatures there occurs no decomposition of the bath, i.e. no precipitation of elemental gold.

Employment of the bath according to the present invention follows in a manner known per se, in that after the base material or substrate is appropriately preheated, it is immersed in the bath solution. It is advantageous herewith to either stir the bath solution or agitate the object to be plated, in order to obtain a uniform, smooth surface.

A further advantage of the bath according to the present invention is that it can be employed repeatedly, without there occurring any precipitation of elemental gold through decomposition of the bath.

The bath can be employed in particular for the chemical gold-plating of metallic surfaces such as gold and metals more electro-negative than gold, for example, copper, silver or nickel, and alloys of these metals.

Another particular advantage of the bath according to the present invention is that, surprisingly, the velocity of deposition remains constant even after a standing period of several months.

Favorably, the bath according to the present invention operates with a uniform velocity of deposition up to 1.5 μm/h.

The bath can be employed with excellent results for the gold-plating of solder compounds produced by means of crystalor wire-formation, which is of great technical value.

Highly uniform and well-adhering and ductile coatings can be deposited from the above described, stabilized bath compositions under the operational conditions set forth herein.

The invention itself, as well as other possible variations and embodiments thereof, will be best understood from the following non-limitative examples of specific embodiments.

DESCRIPTION OF THE PREFERRED EMBODIMENTS

EXAMPLE 1

| | |
|---|---|
| Potassium dicyanoaurate-I | 0.03 mol/liter |
| Potassium cyanide | 0.20 mol/liter |
| Potassium hydroxide | 0.40 mol/liter |
| Potassium borohydride | 0.80 mol/liter |
| Ethylene glycol monoethylether | 2.00 mol/liter |
| pH-value | 13.5 |
| Temperature | 70° C. |
| Deposition velocity | 0.6 μm/h |

EXAMPLE 2

| | |
|---|---|
| Ammonium dicyanoaurate-I | 0.015 mol/liter |
| Sodium cyanide | 0.20 mol/liter |
| Sodium hydroxide | 0.40 mol/liter |
| Sodium borohydride | 0.60 mol/liter |
| Diethylene glycol monoethylether | 4.00 mol/liter |
| pH-value | 14 |
| Temperature | 80° C. |
| Deposition velocity | 1.0 um/h |

While the invention has been described and illustrated as embodied in a stabilized, alkaline, gold bath for the electroless deposition of gold, it is not intended to be limited to the details shown, since various modifications and structural changes can be made without departing in any way from the spirit of the present invention.

Without further analysis, the foregoing will so fully reveal the gist of the present invention that others can without undue experimentation and without omitting features that, from the standpoint of prior art, fairly constitute essential features of the generic or specific aspects of this invention, readily adapt it for various applications.

I claim:

1. Stabilized, aqueous, alkaline gold bath, containing a dycyano-gold(I)-complex in an amount of 0.05 - 30 grams per liter gold, calculated as metal, 10 - 100 grams per liter of a complex-former, 5 - 100 grams per liter of an alkali hydroxide and 10 - 100 grams per liter of a reducing agent, for the electro-less deposition of gold onto gold, metals which are more electro-negative than gold, as well as alloys of these metals, characterized by a content of 50 - 700 grams per liter of at least one compound selected from the group consisting of glycol derivatives and polyethylenimine as stabilizer.

2. The gold bath according to claim 1, wherein said glycol derivative is selected from the group consisting of ethylene glycol, diethylene glycol and polyethylene glycol.

3. The gold bath according to claim 2, containing as stabilizer ethylene glycol of the formula $$R—O—CH_2—CH_2—OH$$

in which R represents hydrogen or alkyl with 1 to 5 carbon atoms.

4. The gold bath according to claim 1, containing as stabilizer ethylene glycol monoethylether of the formula $$HO—CH_2—CH_2—OC_2H_5.$$

5. The gold lbath according to claim 2, containing as stabilizer diethylene glycol of the formula $$(R_1OCH_2CH_2)_2O$$

in which $R_1$ represents hydrogen and/or alkyl with 1 to 5 carbon atoms.

6. The gold bath according to claim 1, containing as stabilizer diethylene glycol monoethylether of the formula $$HO—CH_2—CXH_2—O—CH_2—Ch_2—OC_2H_5.$$

7. The gold bath according to claim 2, containing as stabilizer polyethylene glycol of the formula $$H(OCH_2—CH_2)_nOH$$

wherein n is an integer from 200 to 14,000.

8. The gold bath according to claim 1, containing as stabilizer polyethylenimine of the formula $$(—Ch_2—CH_2—NH—)_n$$

in which n is an integer from 11 to 99.

9. The gold bath according to claim 1, containing said stabilizer in a concentration from 50 to 700 g/liter.

10. The gold bath according to claim 1, wherein said dicyano-gold (1)-complex is selected from the group consisting of alkali-dicyanoaurate(I) and ammonium dicyanoaurate (I).

11. The gold bath according to claim 10, wherein said alkali-dicyanoaurate(I) is sodium dicyanoaurate(I) or potassium dicyanoaurate(I).

12. The gold bath according to claim 1, wherein said dicyanogold(I)-complex is present in a concentration from 0.05 to 30 g gold/liter.

13. The gold bath according to claim 1, wherein said reducing agent is an alkali-borohydride.

14. The gold bath according to claim 1, wherein said complex-former is an alkali-cyanide.

15. The gold bath according to claim 14, wherein said alkali-cyanide is provided in a molar ratio from 1:5 to 1:10, relative to said dicyano-gold(I)-complex, thereby providing an excess of free cyanide.

16. The gold bath according to claim 1, displaying a pH-value greater than 13.

17. The gold bath according to claim 1, wherein said reducing agent and said stabilizer are provided in a molar ratio of 1:4.

18. Process for the electro-less deposition of gold onto gold, metals that are more electro-negative than gold, or alloys of these metals, comprising placing a metal or metal-coated substrate onto which gold isto be deposited into the gold bath according to claim 1, said bath displaying a temperature from 40° to 90° C. and a deposition velocity up to 1.5 μm/h.

* * * * *